United States Patent [19]

Pattermann

[11] Patent Number: 4,935,587

[45] Date of Patent: Jun. 19, 1990

[54] DEVICE FOR ACTUATING A WARNING DEVICE IN COMBINATION WITH A LOCK FOR A DOOR, WINDOW OR THE LIKE

[76] Inventor: Hannibal Pattermann, Västerhaninge, Sweden

[21] Appl. No.: 216,567

[22] Filed: Jul. 8, 1988

[30] Foreign Application Priority Data

Jul. 9, 1987 [SE] Sweden ..... 8702823

[51] Int. Cl.[5] ..... H01H 27/06; G08B 13/08

[52] U.S. Cl. ..... 200/61.64; 200/61.67; 340/542; 340/545

[58] Field of Search ..... 200/61.62, 61.64, 61.67, 200/61.71–61.75, 61.76, 61.78, 61.79, 61.81, 61.68, 61.93; 340/542, 545, 549

[56] References Cited

U.S. PATENT DOCUMENTS

| | | | |
|---|---|---|---|
| 2,804,040 | 8/1957 | Fickes | 116/86 |
| 3,091,760 | 5/1963 | Spenard et al. | 200/61.73 X |
| 3,695,212 | 10/1972 | Gantt | 116/8 |
| 3,892,933 | 7/1975 | Rocchitelli | 200/61.64 X |
| 4,006,121 | 2/1977 | Isono | 200/61.64 |
| 4,465,997 | 8/1984 | Hines | 340/545 X |
| 4,472,706 | 9/1984 | White | 340/546 |
| 4,531,029 | 7/1985 | Trimble | 340/545 X |

*Primary Examiner*—J. R. Scott

*Attorney, Agent, or Firm*—Fleit, Jacobson, Cohn, Price, Holman & Stern

[57] ABSTRACT

A device for actuating a warning device includes a contactor for actuating an electric circuit of the warning device, which contactor is operated for switching-in by means of a movable touch pin, which touch pin, by means of a spring force acting thereon, follows the relative movement between a fixed point and a point belonging to a door leaf, a window or the like, so that when the distance between these two points is increased, the touch pin moves so much that the contactor is operated into its switching-in position. In order to form a small unit, which can be built-in into the conventional securing plates of doors, windows and the like, the touch pin is connected with a catch, which in its catching position holds the touch pin in a fixed position, at least against movements in the direction in which the spring force acts. The catch is controlled by a lock plunger bolt or by the corresponding movable parts of a lock for a door, window and the like, in order to be held firstly in its catching position and secondly in a position in which the touch pin is released.

1 Claim, 1 Drawing Sheet

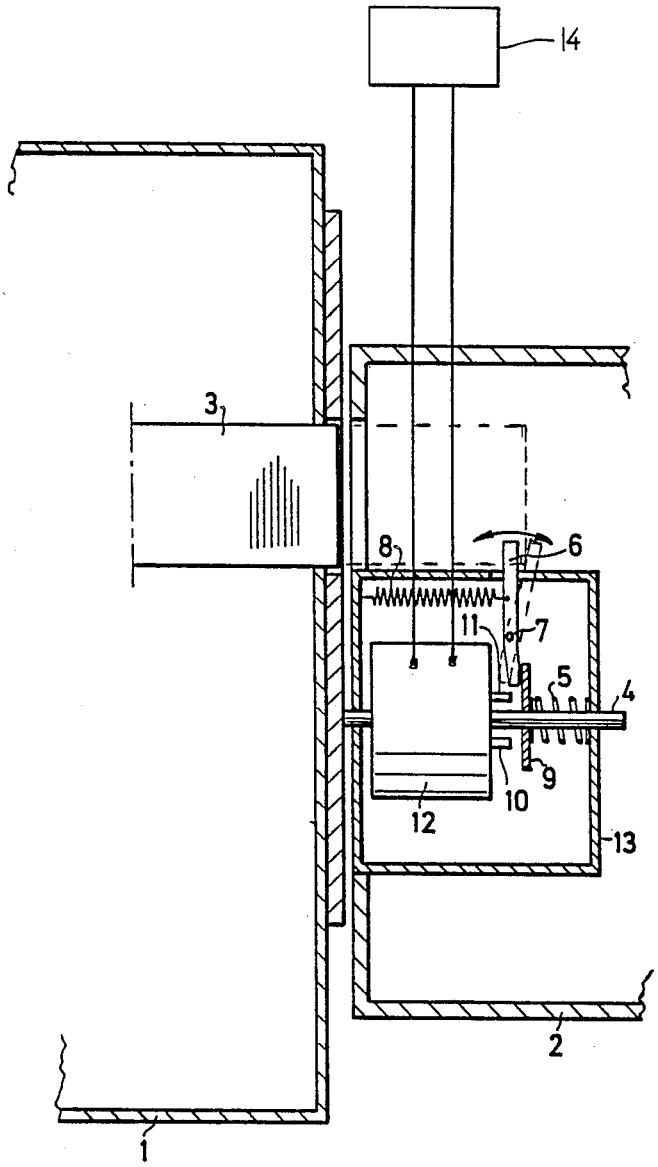
14
3
8
6
11
7
5
4
9
10
12
13
2
1

DEVICE FOR ACTUATING A WARNING DEVICE IN COMBINATION WITH A LOCK FOR A DOOR, WINDOW OR THE LIKE

BACKGROUND AND SUMMARY OF THE INVENTION

This invention relates to a means for actuating a warning device including a contactor for actuating an electric circuit of the warning device, which contactor is operated for switching-in by means of a movable touch pin, which by means of a spring force follows the relative movement between a fixed point and a point belonging to a door leaf panel, window or the like, so that when the distance between said points is increased over a current amount, the said touch pin is operated to the position of switching-in.

The object of the invention is to form such a small unit for actuating the alarm signal of a conventional warning device, which unit in a simple way can be built-in into the conventional securing plates of doors, windows and the like. The unit can also be used in other lockable arrangements, where the object of the warning device is to give alarm as soon as the mutual position between a movable door and a frame or the like is changed. When somebody is trying to open a locked door or the like by force, crow bars or the like are often used, and this will mean that the door unavoidably will be displaced from its position in cooperation with a frame or the like, and the object of the warning device is to indicate or give alarm as soon as said distance fixed by the locked position is altered.

The characterizing features of the invention which give a solution of the above stated problem, are stated in the enclosed claims. An embodiment of the invention will be described in the following with reference to the accompanying drawing.

BRIEF DESCRIPTION OF THE DRAWING

The enclosed drawing is a side view showing schematically the principle of the invention. The view is partly a cross-section of the device according to the invention.

DETAILED DESCRIPTION OF THE INVENTION

The drawing shows schematically a door leaf 1 and a part of a cooperating frame in the form of a securing plate 2. The door leaf 1 has a lock (not shown) which lock includes a lock plunger bolt 3, which in its locking position projects into the securing plate 2 as shown in broken lines. If the door leaf 1 is to be broken up intentionally, that is to say one will open the door without unlocking the lock plunger, the door leaf will be displaced in relation to the securing plate 2, so that the distance between those two parts is increased. If so, an alarm 14 is actuated.

The alarm 14 is shown in block form only, this being any known warning device, and a device according to the invention for actuating the alarm is shown. The alarm 14 is actuated when the distance between the door leaf 1 and the securing plate 2 is increased. The alarm actuating device includes a touch pin 4, which is pressed to the left in the drawing by means of a spring 5. That is to say the touch pin is pressed to the left in order to contact the edge of the door leaf 1. A catch means 6 in the form of an arm, which is pivotally supported by a fulcrum 7 contacts a contacting plate 9 fastened to the touch pin 4 and keeps the touch pin 4 in a retracted position to the right in the drawing as shown in solid lines. This is performed by a spring 8, which is so connected to the catch means 6 that the force of the spring 8 overcomes the force of the spring 5. When the contacting plate 9 contacts two terminals 10 and 11, the electric circuit is closed, said electric circuit including the alarm device 14, and the alarm signal is actuated. The terminals 10 and 11 belong to the contactor 12, which can be any known type of contactor. A microswitch can alternatively be used, where the plate 9 actuates a contact pin of the microswitch.

In order to arm the device, i.e. so that the touch pin 4 can move freely with the contactor, the not shown lock is locked as known per se so that the lock plunger bolt 3 projects into the securing plate 2 and pivots the catch means 6 clockwise shown in dotted lines in the direction of the arrow. As the dotted outline of the catch means 6 in the drawing shows, the lower part of the catch means 6 is now no longer in the way of the plate 9 from contacting the terminals 10 and 11 should this be required to happen if the locked door is tampered with. The touch pin 4 will remain pressed to the left in the drawing by the spring 5 as far as possible, i.e. until the tip of the touch pin 4 contacts the lock or the edge of the door leaf 1. When in this position the touch pin 4 is so adjusted, e.g. by being connected to the contactor plate 9 by means of screw threads (not shown), so that the contactor plate 9 does not reach the terminals 10 and 11. The contactor plate will stop and will be kept at a certain distance from the terminals, due to the fact that the tip of the touch pin 4 is in contact with the edge of the door leaf 1.

If now someone is going to break up the locking connection between the door leaf 1 and the securing plate 2, the mutual distance between the door leaf 1 and the securing plate 2 will increase, which means that the touch pin 4 will be pressed further to the left by the spring 5 so that the contacting plate 9 will contact the two terminals 10 and 11. The electric circuit is closed and the alarm 14 will be actuated. On the other hand, when someone who has a key for the lock and is going to open the door turns the key and the lock plunger bolt 3 is retracted, the catch means 6 and the spring 8 will move the touch pin 4 to the right and will keep the touch pin 4 in this position, which means that the door leaf 1 can be turned up or be retracted from the securing plate 2 without the touch pin moving to the left and contacting the terminals 10 and 11. The alarm 14 will thus not be actuated when the lock is operated by a key. This is the position shown in solid lines in the drawing.

As can be seen drawing, the contactor 12 and accompanying parts are encased in a small housing 13 and this housing forms a small unit, which can be placed within the securing plate 2 or wherever a fixed point in relation to the door leaf 1 can be arranged.

It should be observed that in the shown embodiment the touch pin 4 is placed in the same plane as the lock plunger bolt 3 and that the catch means 6 is controlled directly by the lock plunger bolt 3. However, within the inventive idea it is possible to place the unit housing 13 in a different plane, e.g. in a plane which is perpendicular to the plane of the lock plunger bolt 3, whereby the touch pin 4 contacts the side panel of the door when the device is in alarming position. The lock plunger bolt 3 will thereby actuate the catch means 6 via a further link or a different pivoting motion of the catch means will be arranged by a different pivoting means. The essential part of the invention is, however, that when the lock plunger 3 is inserted into the securing plate 2 and thus the lock is locked, the lock plunger 3 actuates the catch means 6 so that it cannot obscure contact of the contacting plate 9 with the terminals 10, 11. In the shown embodiment the catch means 6 cooperates with the contacting plate 9. The coupling between the catch means 6 and the touch pin 4 can, however, be arranged directly or in a different way so that the touch pin 4 can be caught in an idle position. It is also within the scope of the invention that the lock plunger bolt 3 does not actuate the catch means 6 but that a specific pin or a specific arm is connected with the motion of the lock plunger bolt 3 and thereby controls the catch means 6. This movable part shall, thus, be controlled by the lock itself when the key is turned. It shall further be noted that the spring 8 is arranged to overcome the force of the spring 5, but this spring may also be another type of spring, e.g. a coil spring placed in pivot point 7.

What is claimed:

1. In combination with a lock of a door, window and the like having a lock plunger bolt extendable from an edge of a panel of the door or window for projecting into a corresponding securing plate of a frame of the door or window for locking same when in a closed condition, and a warning device which includes an electric circuit for actuating an alarm, an apparatus for actuating the electric circuit of the warning device upon any relative displacement between the door or window and its frame not accompanied by withdrawing of the lock plunger bolt, comprising:

a touch pin mounted in the frame opposite the edge of the panel and movable toward and away from the panel edge, the touch pin having a tip;

a first spring biasing the touch pin toward the panel edge so as to cause the touch pin to extend from the frame for contacting the panel edge when the panel is in a closed position in the frame, whereby the touch pin movably follows the relative movement between the panel edge and a fixed point of the frame;

a contact plate fastened on the touch pin and movable therewith;

catch means pivotally mounted to the frame and pivotable between a catching position and a releasing position, the catch means being in the form of an arm one end of which is engagable by the projecting lock plunger bolt when the lock is locked, the arm having another end which contacts an edge of the contact plate when the one end of the arm is not engaged by the lock plunger bolt;

a second spring biasing the catch means against the force of the first spring and towards the lock plunger bolt so as, when the one end of the catch means arm is not engaged by the projecting lock plunger bolt, to urge the catch means toward the catching position thereof to cause the other end of the catch means arm to engage the contact plate and to catch the touch pin in a retracted position with the tip of the touch pin held away from the panel edge; and a contactor mounted on the frame adjacent the touch pin, the contactor having a pair of terminals connected into the warning device actuating circuit which pair of terminals when contacted by the contact plate fastened to the touch pin, complete the warning device actuating circuit;

whereby when the lock is locked the projecting lock plunger bolt engages the catch means so as to place the catch means in its said releasing position with the touch pin tip just contacting the panel edge, so that the contact plate is held spaced apart from the terminals of the contactor, and whereby any relative displacement of the panel edge and the frame which causes an increase in the distance between the fixed point of the frame and the corresponding point on the panel edge will cause the touch pin, under the urging of the first spring, to move toward the panel edge and to cause the contact plate to contact the terminals of the contactor for completing the warning device actuation circuit.

* * * * *